US007000366B2

(12) United States Patent
Borghi et al.

(10) Patent No.: US 7,000,366 B2
(45) Date of Patent: Feb. 21, 2006

(54) DECORATION CORRECTION METHOD AND SYSTEM FOR A FORM-AND-SEAL UNIT

(75) Inventors: Davide Borghi, Modena (IT); Behrooz Faskhoody, Formigine (IT); Bo Hellberg, Veberöd (SE)

(73) Assignee: Tetra Laval Holdings & Finance S.A., Pully (SE)

( * ) Notice: Subject to any disclaimer, the term of this patent is extended or adjusted under 35 U.S.C. 154(b) by 0 days.

(21) Appl. No.: 10/480,473

(22) PCT Filed: Jun. 13, 2002

(86) PCT No.: PCT/EP02/06514

§ 371 (c)(1),
(2), (4) Date: Dec. 12, 2003

(87) PCT Pub. No.: WO02/102667

PCT Pub. Date: Dec. 27, 2002

(65) Prior Publication Data

US 2004/0168407 A1 Sep. 2, 2004

(30) Foreign Application Priority Data

Jun. 14, 2001 (EP) ..... 01830392

(51) Int. Cl.
*B65B 9/00* (2006.01)
*B65B 57/10* (2006.01)

(52) U.S. Cl. ..... 53/451; 53/52; 53/375.9; 493/8

(58) Field of Classification Search ..... 53/451, 53/452, 467, 373.7, 375.9, 52; 493/8, 11
See application file for complete search history.

(56) References Cited

U.S. PATENT DOCUMENTS

| | | | | |
|---|---|---|---|---|
| 1,897,612 | A * | 2/1933 | Helfrecht | 53/52 |
| 3,350,840 | A * | 11/1967 | Grafingholt et al. | 53/554 |
| 3,629,987 | A * | 12/1971 | Klopfenstein et al. | 53/552 |
| 4,128,985 | A * | 12/1978 | Simmons | 53/51 |
| 5,347,795 | A * | 9/1994 | Fukuda | 53/552 |
| 5,412,927 | A * | 5/1995 | Miyazaki et al. | 53/552 |

FOREIGN PATENT DOCUMENTS

| | | |
|---|---|---|
| EP | 0 380 868 | * 6/1994 |
| EP | 0 764 580 | * 9/1995 |
| EP | 0 959 007 | * 11/1999 |
| EP | 0959007 | 11/1999 |

* cited by examiner

*Primary Examiner*—Stephen F. Gerrity
*Assistant Examiner*—Paul Durand
(74) *Attorney, Agent, or Firm*—Buchanan Ingersoll P.C.

(57) ABSTRACT

A decoration correction method for a form-and-seal unit for producing sealed packages of a pourable food product from a tube of packaging material fed along a feed path, and having two pairs of jaws movable along the feed path and opened and closed so as to travel, cyclically and alternately with each other, along a form-and-seal portion along which the pairs of jaws are closed and travel integrally with the tube, and along a repositioning portion along which the pairs of jaws open and move with respect to the tube. To make a decoration correction, a nominal trajectory of the jaws is modified along the repositioning portion on the basis of a position error of the tube with respect to a nominal position. A first solution provides for correcting the travel of the jaws by selectively modifying the amplitude of the trajectory; and a second solution provides for correcting the phase of the jaw trajectory.

28 Claims, 7 Drawing Sheets

DECORATION CORRECTION METHOD AND SYSTEM FOR A FORM-AND-SEAL UNIT

TECHNICAL FIELD

The present invention relates to a decoration correction method and system for a form-and-seal unit of a machine for packaging pourable food products.

BACKGROUND ART

Machines for packaging pourable food products—such as fruit juice, wine, tomato sauce, pasteurized or long-storage (UHT) milk, etc.—are known, on which the packages are formed from a continuous tube of packaging material defined by a longitudinally sealed web.

To produce the packages, the tube of packaging material is filled continuously with the pourable food product, and is then fed to a form-and-(transverse) seal unit on which the tube is gripped between pairs of jaws and sealed transversely to form pillow packs.

Once sealing is completed, a knife cuts the tube of packaging material along the center of the sealed portion to cut a pillow pack off the bottom end of the tube of packaging material. The bottom end being sealed transversely, the jaws, on reaching the bottom dead-center position, can be opened to avoid interfering with the top portion of the tube; and, at the same time, the other pair of jaws, operated in the same way, moves down from the top dead-center position and repeats the same gripping/forming, sealing and cutting operations.

One problem with known form-and-seal units has to do with the so-called "decoration correction" system.

That is, the web of packaging material normally comprises a series of equally spaced printed images or decorations on the portions eventually forming the outer surfaces of the packs, so that the web must be fed to the form-and-seal unit in such a manner as to register forming, sealing and cutting of the packs with the succession of decorations. In actual use, since the decorations are printed equally spaced, the position of each with respect to the position of the jaws on the form-and-seal unit may vary, firstly as a result of varying deformation of the packaging material by the mechanical pressure exerted on it by the jaws, and, secondly, as a result of the pulsating pressure of the pourable food product inside the tube of packaging material. A system for position correcting the decoration is therefore required.

On modern packaging machines, such a system comprises an optical sensor for detecting the position of a bar code on each pack; and a control unit for comparing the detected position with respect to a theoretical position.

On some commercial machines, each pair of jaws has a pair of traction members for drawing the tube of packaging material, which are movable with respect to the jaws to form triangular tabs at the top and bottom corners of the pillow packs. On detecting a decoration position error, the control unit adjusts the speed of the motor controlling feed of the web of packaging material. If this correction is not sufficient, the tube traction members are controlled to slightly increase or reduce pull on the packaging material. According to other solutions, the control unit acts directly on the tube traction members, with no possibility of adjusting the speed of the motor controlling feed of the web of packaging material; and the operation is repeated until the position of the decoration coincides with the theoretical position, which may only occur after a certain number of packs have been produced, and which must therefore be rejected. At times, this method also fails to correct the position of the decoration, as, for example, when loading a new reel of packaging material with a different decoration spacing. In which case, the machine must be stopped and reset manually to the new spacing.

European Patent Application EP-A-0 959 007 describes a form-and-seal unit of the above type, in which the reciprocating movement of each jaw is controlled by two rods activated by respective servomotors. Independent control of the four rods therefore provides for taking into account any error in the position of the decoration, and for controlling the operating speed of the jaw assemblies accordingly.

DISCLOSURE OF THE INVENTION

It is an object of the invention to perfect the form-and-seal unit described in EP-A-0 959 007, by enabling correction of the decoration in a mechanically simple, reliable manner, and with no need for additional servomotors or electronic control boards.

According to the present invention, there are provided a decoration correction method and system for a form-and-seal unit of a machine for packaging pourable food products, as described herein.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 1:
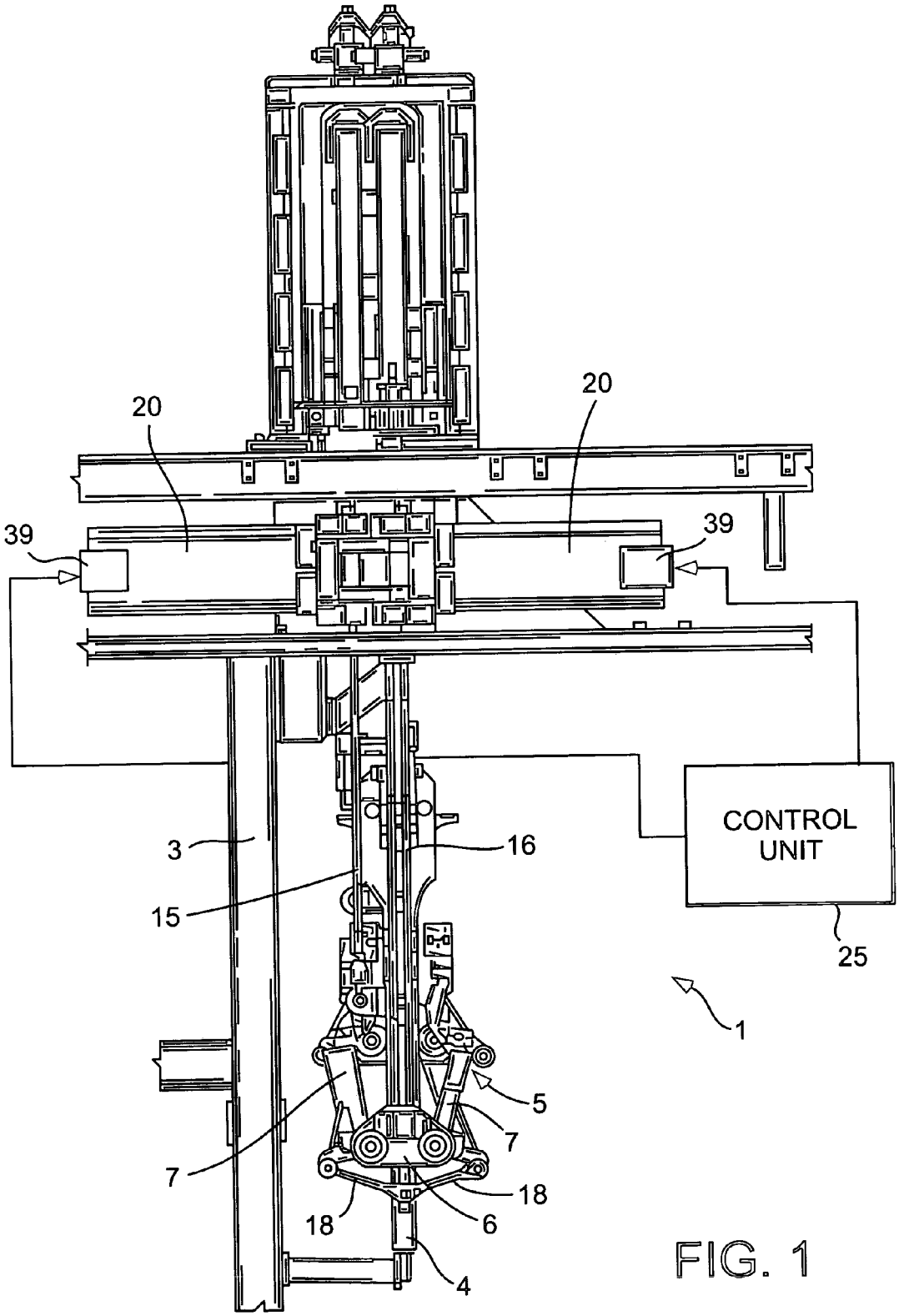
FIGS. 1 and 2 show side and front views respectively of a form-and-seal unit of a machine for packaging pourable food products and implementing a decoration correction system in accordance with the invention.

For a clearer understanding of the invention, a form-and-seal unit 1 in accordance with Application EP-A-0 959 007 will first be described.

Unit 1 provides for producing aseptic sealed packages of a pourable food product from a tube 2 of packaging material formed by longitudinally folding and sealing a web of heat-seal sheet material, and filled with the food product upstream from unit 1.

Unit 1 comprises a supporting structure 3 defining two vertical guides 4 along which run two forming assemblies 5, 5'.

Figure 2:
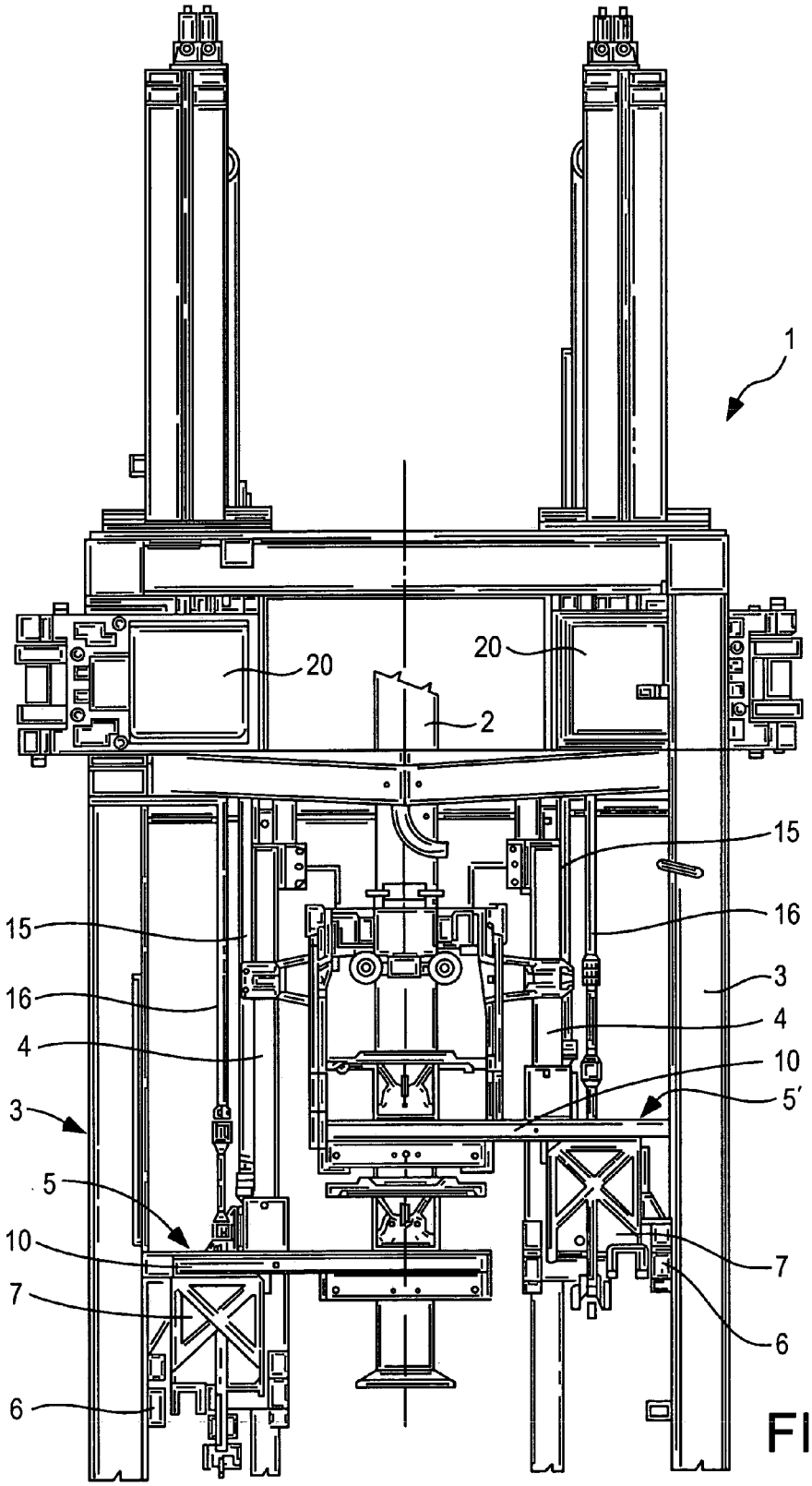

Each forming assembly 5, 5' substantially comprises a yoke 6 running along a respective guide 4; and two jaws 7 hinged at the bottom to the yoke and located on opposite sides of tube 2 (FIG. 2). Jaws 7 are fitted integrally with respective supporting arms 10, which are fixed to the top ends of respective jaws 7, project towards each other, and support respective bar-shaped sealing elements (not shown) interacting with tube 2.

The movement of each jaw 7 is controlled by a first and a second vertical rod 15, 16, which respectively control the vertical movement of the forming assembly 5, 5' and opening/closing of the respective pair of jaws 7.

More specifically, jaws 7 of each forming assembly 5, 5' close as the assembly moves down, so as to grip tube 2 with a downward vertical component of motion equal to the traveling speed of tube 2. As they move down, jaws 7 are kept closed, and the sealing elements (not shown) grip the tube to the required heat-seal pressure (form-and-seal portion). On nearing the bottom dead-center position, jaws 7 open to release tube 2, and are opened completely as they move upwards and prior to reaching the top dead-center position (repositioning portion). At this point, jaws 7 begin closing, and are fully closed by the time they begin moving down.

In effect, the opening/closing movement of jaws 7 is superimposed on the vertical reciprocating movement of yokes 6, so that rods 15 perform a reciprocating movement, while rods 16 perform a periodic axial movement produced by the reciprocating movement of rods 15 combined with a further periodic component of motion for controlling the opening and closing of jaws 7.

The movements of the two forming assemblies 5, 5' are obviously offset by a half cycle: forming assembly 5 travels upwards with jaws 7 open, at the same time as forming assembly 5' travels downwards with the jaws closed, so as to prevent interference.

Rods 15, 16 of each forming assembly 5, 5' are controlled independently by respective servomotors 20 connected to a control unit 25 programmed to vary the operating parameters of servomotors 20 and so vary the operating cycles of unit 1.

According to the invention, in the event of a decoration position error, the movement of each pair of jaws 7 (controlled by servomotors 20 via rods 15, 16) is modified along the repositioning portion, as jaws 7 travel upwards. More specifically, control unit 25 varies the travel or phase of one or both jaws.

Figure 3:
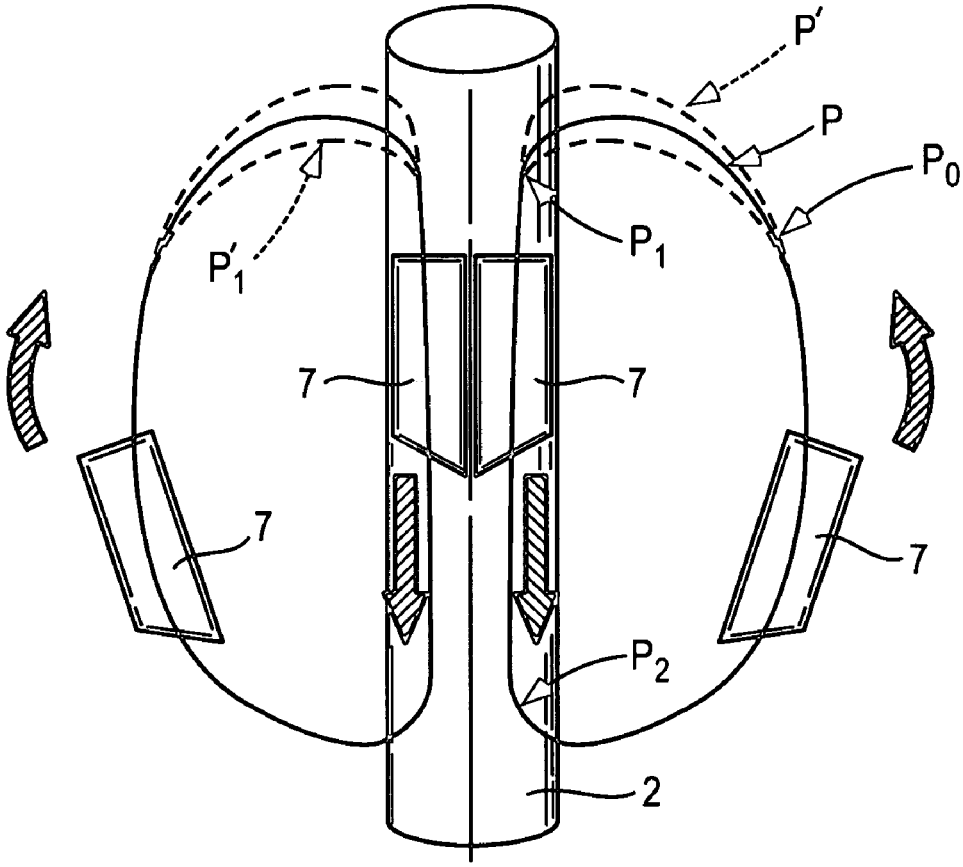
FIG. 3 shows schematically the result of the jaws movement control in the FIGS. 1 and 2 machine to correct the decoration according to the invention.

FIG. 3 shows how the trajectory of a pair of jaws 7 is modified according to the first solution (travel variation). More specifically, FIG. 3 shows, by the continuous line, the nominal curved trajectory P, and, by the dash lines, a first modified trajectory P' in the event the position error calls for increasing the height of the pack, and a second modified trajectory P" in the event the position error calls for reducing the height of the pack. In FIG. 3, the trajectories of jaws 7 of both forming assemblies 5, 5' are shown together, even though the two trajectories are obviously offset in time with respect to each other.

In the example shown, the modified trajectories P', P" deviate from nominal trajectory P along the repositioning portion between a point $P_0$ (upward travel, just before the jaws begin closing) and a point $P_1$ (start of the downward travel, just below the top dead-center position), and are identical with the nominal trajectory between points $P_1$ and $P_2$ (downward travel to a point just short of the bottom dead-center position), when the existing relationships are best left unchanged while forming the pack, and between points $P_2$ and $P_0$ (upward travel with jaws 7 opening). Alternatively, modified trajectories P' and P" may deviate just after point $P_2$.

Indeed, the modified trajectories P' and P" in FIG. 3 can be obtained by modifying the actual travel of jaws 7, i.e. the distance between the top and bottom dead-center positions, so that, at each modified cycle, jaws 7 travel along a longer or shorter trajectory P', P" respectively. In this case, control unit 25 modifies, on assembly 5 or 5', the travel of both rods 15, 16 controlling the movement of yoke 6 and jaws 7, so as to compensate the detected position error as described in detail below with reference to FIG. 4.

Figure 4:
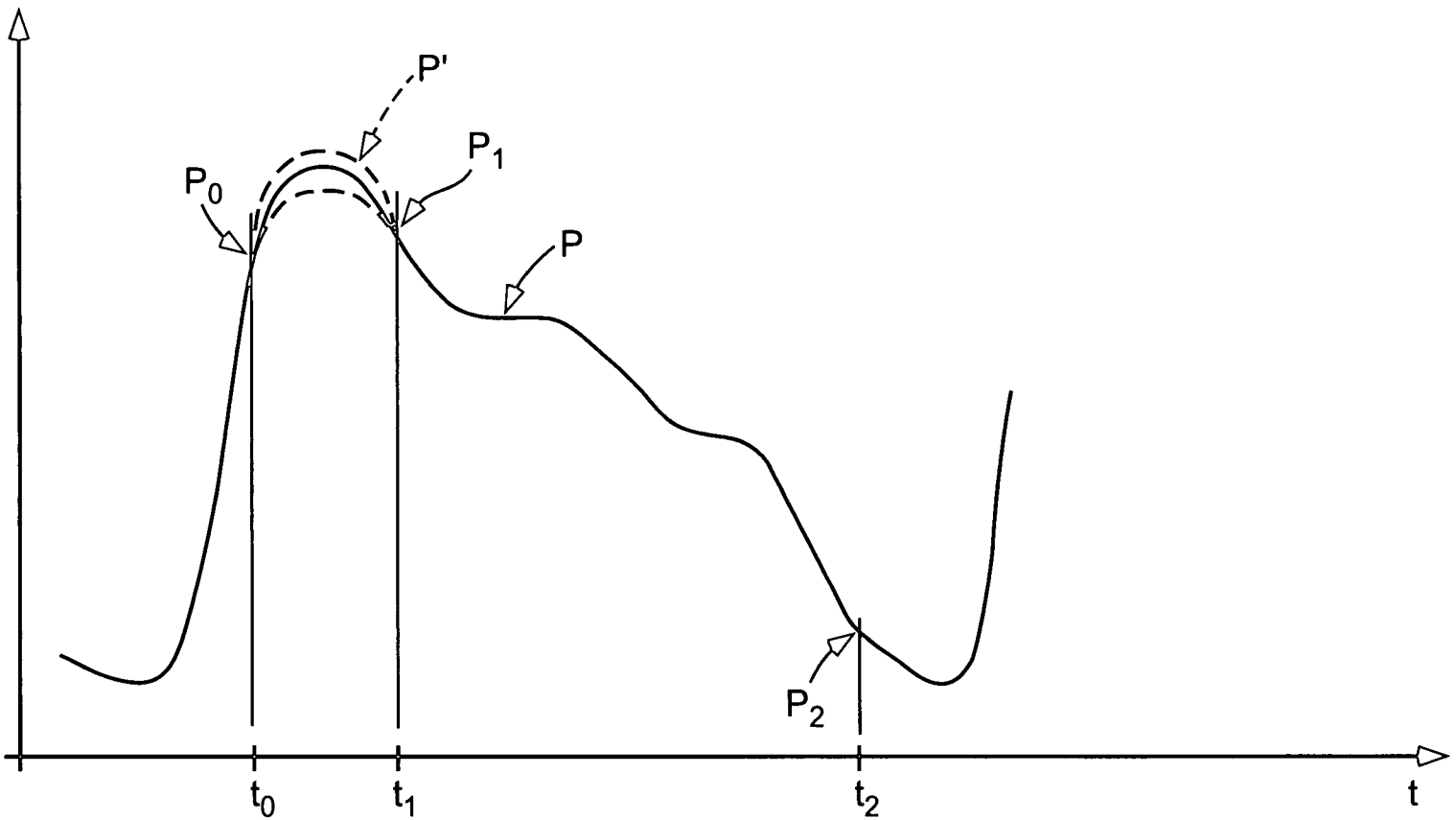
FIG. 4 shows a time plot of jaw trajectories obtained controlling the travel of the jaws.

According to this first solution, the nominal trajectory P as a function of time is modified as shown in FIG. 4, which shows the position of jaws 7 as a function of time, and in which P, P' and P" indicate the nominal and modified trajectories respectively, and $P_0$–$P_2$ have the same meanings as in FIG. 3. As can be seen, the trajectory is only modified between $P_0$ and $P_1$, the rest of the trajectory remaining unchanged.

According to a second solution, the actual trajectory of jaws 7 remains unchanged, and the phase of rods 15, 16 is delayed or advanced by an appropriate amount. With respect to a fixed coordinate system, therefore, the trajectory of rods 15, 16 remains unchanged, and their instantaneous position is modified to delay (or advance, depending on the detected position error) the instant $P_1$ in which the upward-moving jaw 7 closes. In this case, the trajectories of the pairs of jaws 7, as "seen" by tube 2, can again be represented as shown in FIG. 3, except that the two trajectories (right and left) are offset in height.

The second solution is particularly useful when not enough space is available on unit 1 to allow extra travel of jaws 7 without interfering with other parts of unit 1.

Figure 5:
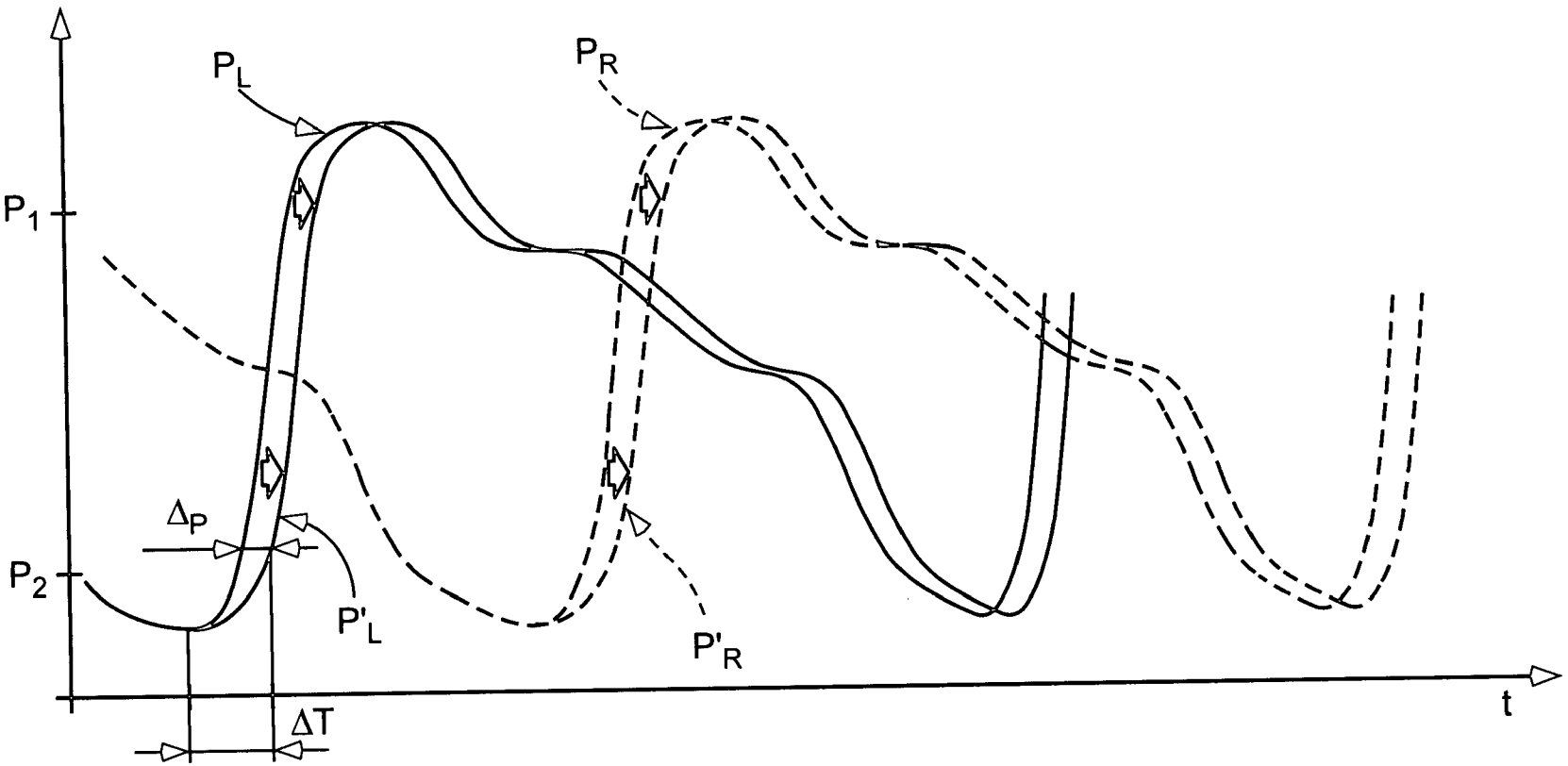
FIG. 5 shows a time plot of jaw trajectories obtained by phase controlling the jaws.

An example of a delayed phase-modified trajectory is shown in FIG. 5, which shows, superimposed, the nominal and modified trajectories $P_L$ and $P'_L$ of the left-hand pair of jaws 7, and the nominal and modified trajectories $P_R$ and $P'_R$ of the right-hand pair of jaws 7. As can be seen, the modified trajectory $P'_L$ of the left-hand pair of jaws 7 deviates from the nominal trajectory $P_L$ just after point $P_2$ (during the time interval $\Delta T$ in which a phase delay $\Delta p$ is generated), and the phase displacement so generated remains unchanged throughout the rest of the cycle (and possibly also at subsequent cycles, if no further decoration position errors occur). Unless further errors occur, the other pair of jaws 7 (the right-hand pair in the example shown) also undergoes the same phase displacement $\Delta p$.

In other words, during interval $\Delta T$, the left-hand pair of jaws 7 is delayed with respect to the right-hand pair, so that the left-hand jaws 7 encounter tube 2 after the nominal instant, whereas the right-hand pair of jaws 7 continues drawing tube 2 at nominal speed. Consequently, the left-hand pair of jaws 7 encounters tube 2 at a higher-than-nominal point (with respect to tube 2) corresponding to an increase in height of the pack. Since the right-hand pair of jaws 7 undergoes the same phase displacement as of the next half cycle (after the right-hand pair of jaws 7 releases tube 2) and the same phase displacement is also maintained at subsequent cycles, the next packs are made to nominal size.

Figure 6:
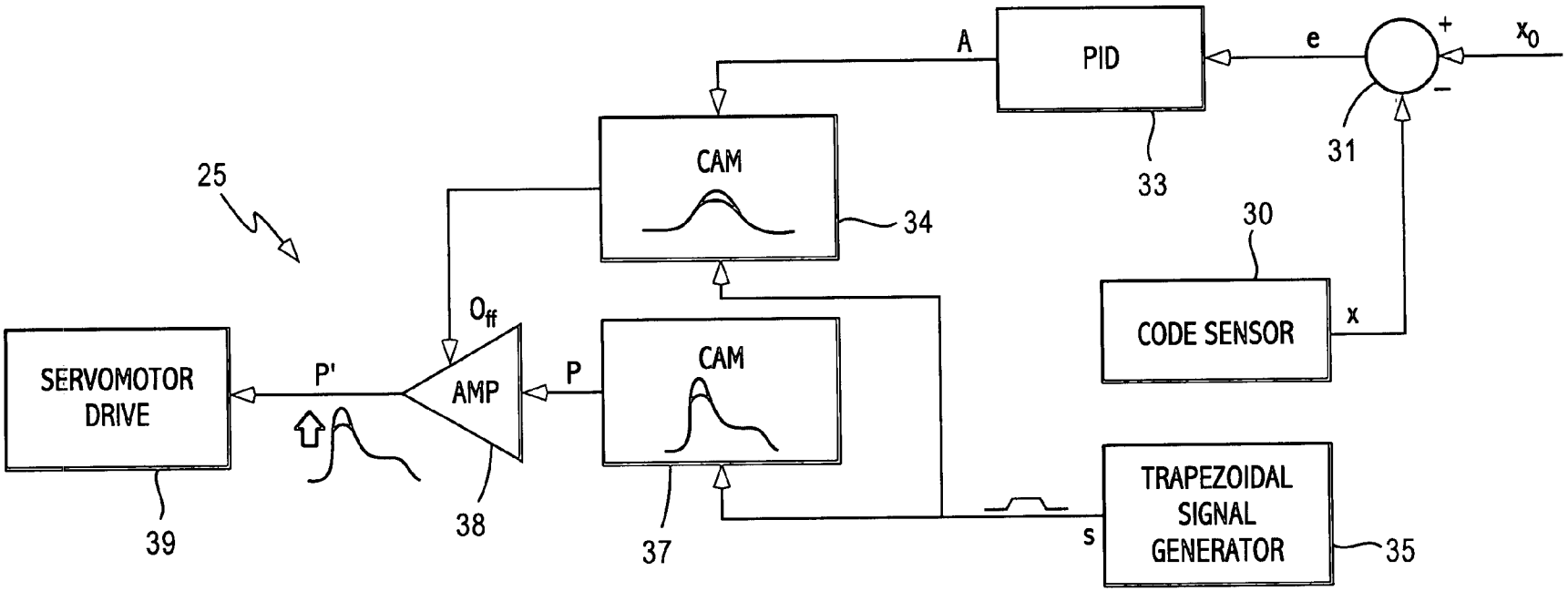
FIG. 6 shows a block diagram of the travel control system for obtaining the FIG. 4 trajectories.

FIG. 6 shows a block diagram of the control circuit for modifying the travel of rods 15, 16 according to the first solution described above, and preferably program implemented by control unit 25.

More specifically, an actual-position signal x—generated by a code sensor 30, which reads the bar code on tube 2 at each pack—is supplied to a subtracting node 31, which also receives a nominal-position signal $x_0$. Subtracting node 31 subtracts the actual-position signal x from the nominal-position signal $x_0$ to obtain an error signal e, which is supplied to a PID (Proportional-Integral-Derivative) control block 33; and PID control block 33 generates in known manner an amplitude correction signal A which indicates the correction to be made to the travel of rods 15, 16 and is supplied to a first electronic cam 34.

First electronic cam 34 also receives a trapezoidal timing signal s generated by a trapezoidal-signal generator 35 and for synchronizing the movement of rods 15, 16 with respect to the rest of unit 1 in known manner. First electronic cam 34 memorizes a Gaussian amplitude correction profile, and generates an offset signal Off synchronized with timing signal s (in particular, only of a value other than zero during the operating interval in which the travel correction is to made) and the amplitude of which is a function of amplitude correction signal A.

Timing signal s is also supplied to a second electronic cam 37, which memorizes nominal trajectory P and generates nominal trajectory P synchronized with unit 1.

Nominal trajectory P is supplied to an adjustable-offset unit-gain amplifier 38, a control input of which receives offset signal Off; amplifier 38 generates modified trajectory P' which, with respect to nominal trajectory P, only varies in height according to offset signal Off; and modified trajectory P' is supplied to a drive circuit 39 connected to and driving a respective servomotor 20 in known manner so that the rod connected to the servomotor is activated according to modified trajectory P'. A control as shown in FIG. 6 is applied to each of the four servomotors 20 of unit 1.

Figure 7:
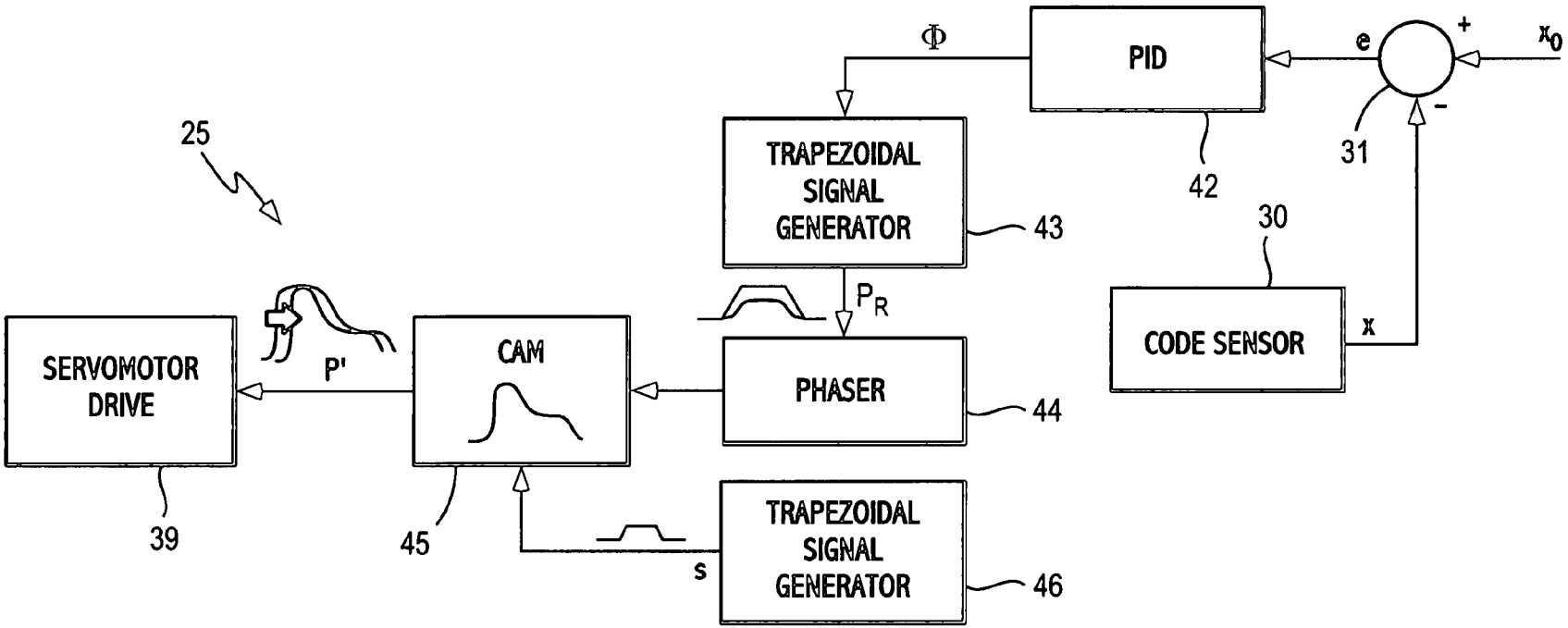
FIG. 7 shows a block diagram of the phase control system for obtaining the FIG. 5 trajectories.

FIG. 7 shows a block diagram of the control circuit for modifying the phase of rods 15, 16 according to the second solution described above, and also preferably program implemented by control unit 25. In FIG. 7, any parts in common with the FIG. 6 control scheme are indicated using the same reference numbers.

More specifically, the actual-position signal x generated by code sensor 30 is supplied to subtracting node 31, which also receives nominal-position signal $x_0$ and generates error signal e. Error signal e is supplied to a PID (Proportional-Integral-Derivative) control block 42 which generates in known manner a phase correction signal $\phi$ indicating the phase correction to be made to the nominal trajectory of rods 15, 16. The phase correction signal $\phi$ is supplied to a variable-amplitude trapezoidal-signal generator 43, which generates a trapezoidal signal Tr whose amplitude is a function of phase correction signal $\phi$. Trapezoidal signal Tr is supplied to a phaser 44, which determines in known manner the phase displacement $\Delta p$ to be made to the nominal trajectory, and which is supplied to a third electronic cam 45 similar to electronic cams 34, 37 in FIG. 6. Third electronic am 45 also receives a timing signal s generated by a trapezoidal-signal generator 46 similar to trapezoidal-signal generator 35 in FIG. 6, and generates the modified trajectory P' offset with respect to timing signal s according to phase displacement $\Delta p$. The modified trajectory P' is then supplied to drive circuit 39 as in the FIG. 6 control system.

The advantages of the control method and system described are as follows. In particular, they provide for correcting the size of the packs accurately and immediately upon detecting any deviation in the position of the decoration with respect to the nominal position, so that all the packs, after the one on which the correction is made, are formed to nominal size, and at most only the pack varied in length need be rejected, without stopping the machine.

Moreover, correction can be made extremely easily by virtue of the software control, so that, if necessary, even combination corrections can be made. For example, in the event of a sizeable position error, a travel correction can be made within the limits of the space available, and the correction completed by modifying the phase of rods 15, 16 and relative jaws 7.

Clearly, changes may be made to the control method and system as described and illustrated herein without, however, departing from the scope of the accompanying Claims. In particular, the invention may be applied to other types of forming units, e.g. in which each half-jaw is operated by a chain powered by a respective servomotor, or to units for producing other types of packs, e.g. tetrahedron-shaped packs.

What is claimed is:

1. A decoration correction method for a form-and-seal unit for producing sealed packages of a pourable food product from a tube of packaging material fed along a feed path, the form-and-seal unit comprising two pairs of jaws movable along said feed path and opened and closed by respective actuating members so as to substantially travel, cyclically and alternately with each other, along a form-and-seal portion along which said pairs of jaws are closed and grip said tube, and along a repositioning portion along which said pairs of jaws open and move along a curved trajectory with respect to said tube, the method comprising the step of modifying, along said repositioning portion, a nominal trajectory of said jaws to a modified trajectory on the basis of an error signal related to a position error of said tube with respect to a nominal position.

2. A method as claimed in claim 1, wherein said step of modifying a nominal trajectory comprises modifying at least one of the amplitude and the phase of said nominal trajectory.

3. A method as claimed in claim 2, wherein said step of modifying the amplitude is performed along an end portion of said repositioning portion.

4. A method as claimed in claim 2, wherein said step of modifying the phase is performed along an initial portion of said repositioning portion.

5. A method as claimed in claim 4, wherein said step of determining a phase correction comprises processing said position error by means of a PID algorithm.

6. A method as claimed in claim 2, wherein said step of modifying the phase comprises determining a phase correction required to eliminate said position error; and phase displacing said nominal trajectory according to said phase correction.

7. A decoration correction method for a form-and-seal unit for producing sealed packages of a pourable food product from a tube of packaging material fed along a feed path, the form-and-seal unit comprising two pairs of jaws which are movable along the feed path and opened and closed by respective actuating members so as to substantially travel, cyclically and alternately with each other, along a form-and-seal portion along which the pairs of jaws are closed and grip the tube, and along a repositioning portion along which the pairs of jaws open and move along a curved trajectory with respect to the tube, the method comprising modifying, along the repositioning portion, a nominal trajectory of the jaws to a modified trajectory on the basis of an error signal related to a position error of the tube with respect to a nominal position, the modifying comprising a step of modifying the amplitude of the nominal trajectory by determining an amplitude correction required to eliminate the position error, and modifying the amplitude according to the amplitude correction.

8. A method as claimed in claim 7, wherein said step of modifying the amplitude comprises generating an amplitude correction curve having an amplitude which is related to said amplitude correction and synchronized with a timing signal; generating said nominal trajectory in synchronized manner with said timing signal; and using said correction curve to modify the amplitude of said nominal trajectory.

9. A method as claimed in claim 8, wherein said step of modifying the amplitude comprises supplying said nominal trajectory to a variable-offset amplifying element; and supplying said amplitude correction curve to an offset control input of said amplifying element.

10. A method as claimed in claim 7, wherein said step of determining an amplitude correction comprises processing said position error by means of a PID algorithm.

11. A decoration correction system for a form-and-seal unit for producing sealed packages of a pourable food product from a tube of packaging material fed along a feed path, the form-and-seal unit comprising two pairs of jaws movable along said feed path and opened and closed by respective actuating members so as to substantially travel, cyclically and alternately with each other, along a form-and-seal portion along which said pairs of jaws are closed and grip said tube, and along a repositioning portion along which said pairs of jaws open and move along a curved trajectory with respect to said tube; the decoration correction system comprising a trajectory modifying unit, which receives a nominal trajectory of said jaws, and an error signal related to a position error of said tube with respect to a nominal position, and based on the error signal generates a modified trajectory of said jaws which is activated along said repositioning portion.

12. A system as claimed in claim 11, wherein said trajectory modifying unit comprises an amplitude control stage selectively modifying the amplitude of said nominal trajectory and/or a phase displacement stage modifying the phase of said nominal trajectory.

13. A system as claimed in claim 12, wherein said phase displacement stage comprises a calculating element for determining a phase correction ($\phi$) required to eliminate said position error; and a modified-trajectory generator, which receives said nominal trajectory and said phase correction, and generates said modified trajectory.

14. A system as claimed in claim 13, wherein said calculating element comprises a PID control block; and said modified-trajectory generator comprises an electronic cam.

15. A decoration correction system for a form-and-seal unit for producing sealed packages of a pourable food product from a tube of packaging material fed along a feed path, the form-and-seal unit comprising two pairs of jaws movable along the feed path and opened and closed by respective actuating members so as to substantially travel, cyclically and alternately with each other, along a form-and-seal portion along which the pairs of jaws are closed and grip the tube, and movable along a repositioning portion along which the pairs of jaws open and move along a curved trajectory with respect to the tube; the decoration correction system comprising a trajectory modifying unit, which receives a nominal trajectory of the jaws, and an error signal related to a position error of the tube with respect to a nominal position, and generates a modified trajectory activated along the repositioning portion, the trajectory modifying unit comprising an amplitude control stage which selectively modifies the amplitude of the nominal trajectory, the amplitude control stage comprising a calculating element for determining an amplitude correction required to eliminate the position error; and a modified-trajectory generator, which receives the nominal trajectory and the amplitude correction, and generates the modified trajectory having a portion with a height which is modified as a function of the amplitude correction.

16. A system as claimed in claim 15, wherein said calculating element comprises a PID control block; and said modified-trajectory generator comprises an electronic cam supplying an amplitude correction curve related to said amplitude correction and synchronized with a timing signal, and a controllable-offset amplifying element having a signal input receiving said nominal trajectory, and an offset control input receiving said amplitude correction curve.

17. A method of correcting a decoration for a form-and-seal unit for producing sealed packages from a tube of packaging material fed along a feed path, the form-and-seal unit comprising two pairs of jaws which are movable along the feed path and opened and closed by respective actuating members so as to substantially travel, cyclically and alternately with each other, along a first portion along which the pairs of jaws are closed and grip the tube, and along a second portion along which the pairs of jaws open and move along a curved trajectory with respect to the tube, the method comprising modifying, along the second portion, a trajectory of the jaws from a nominal trajectory to a modified trajectory on the basis of an error signal related to a position error of the tube with respect to a nominal position.

18. A method as claimed in claim 17, wherein the modified trajectory increases the height of the sealed package relative to the nominal trajectory.

19. A method as claimed in claim 17, wherein the modified trajectory decreases the height of the sealed package relative to the nominal trajectory.

20. A method as claimed in claim 17, wherein the modified trajectory deviates from the nominal trajectory along the second portion between a point just before the jaws begin to close and a point at the start of travel along the first portion.

21. A method as claimed in claim 17, wherein the modified trajectory deviates from the nominal trajectory along the second portion between a point just before the jaws begin to close during upward travel and a point at the start of downward travel.

22. A method as claimed in claim 17, wherein the modified trajectory is identical with the nominal trajectory along the first portion.

23. A method as claimed in claim 17, wherein the modified trajectory of the jaws is obtained by modifying a distance between top and bottom dead-center positions of the jaws.

24. A method as claimed in claim 17, wherein the trajectory of the jaws is only modified along the second portion which is from a point just before the jaws begin to close during upward travel to a point at the start of downward travel.

25. A method as claimed in claim 17, wherein the modifying comprises modifying the phase of the nominal trajectory.

26. A method as claimed in claim 25, wherein an instant at which an upward moving jaw is closed is delayed or advanced depending on the position error of the tube with respect to the nominal position.

27. A method as claimed in claim 25, wherein a nominal trajectory and a modified trajectory of a first pair of jaws deviates from a nominal trajectory and a modified trajectory of a second pair of jaws.

28. A decoration correction system for a form-and-seal unit for producing sealed packages from a tube of packaging material fed along a feed path, the form-and-seal unit comprising two pairs of jaws movable along the feed path and opened and closed by respective actuating members so as to substantially travel, cyclically and alternately with each other, along a first portion along which the pairs of jaws are closed and grip the tube, and along a second portion along which the pairs of jaws open and move along a curved trajectory with respect to the tube; the decoration correction system comprising a trajectory modifying unit, which receives a nominal trajectory of the jaws, and an error signal related to a position error of the tube with respect to a nominal position, and generates a modified trajectory of the jaws which is activated along the second portion.

* * * * *